US011492902B2

(12) United States Patent
Kumar et al.

(10) Patent No.: US 11,492,902 B2
(45) Date of Patent: Nov. 8, 2022

(54) WELL OPERATIONS INVOLVING SYNTHETIC FRACTURE INJECTION TEST

(71) Applicant: Landmark Graphics Corporation, Houston, TX (US)

(72) Inventors: Amit Kumar, Houston, TX (US); Steven Patton Knabe, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 106 days.

(21) Appl. No.: 17/054,608

(22) PCT Filed: Aug. 27, 2019

(86) PCT No.: PCT/US2019/048310
§ 371 (c)(1),
(2) Date: Nov. 11, 2020

(87) PCT Pub. No.: WO2020/060729
PCT Pub. Date: Mar. 26, 2020

(65) Prior Publication Data

US 2021/0102461 A1 Apr. 8, 2021

Related U.S. Application Data

(60) Provisional application No. 62/734,428, filed on Sep. 21, 2018.

(51) Int. Cl.
*E21B 47/10* (2012.01)
*E21B 49/00* (2006.01)
(Continued)

(52) U.S. Cl.
CPC ..... *E21B 49/008* (2013.01); *E21B 43/26* (2013.01); *E21B 44/02* (2013.01); *E21B 2200/20* (2020.05)

(58) Field of Classification Search
CPC ..... E21B 49/00; E21B 47/00; E21B 49/008; E21B 47/10
See application file for complete search history.

(56) References Cited

U.S. PATENT DOCUMENTS 6,705,398 B2 * 3/2004 Weng ..... E21B 49/008 166/250.1
7,277,796 B2 * 10/2007 Kuchuk ..... E21B 49/00 702/7

(Continued)

FOREIGN PATENT DOCUMENTS

WO 2017151100 A1 9/2017

OTHER PUBLICATIONS

Castillo , "Modified Fracture Pressure Decline Analysis Including Pressure-Dependent Leakoff", SPE-16417-MS, Society of Petroleum Engineers, 1987, pp. 273-281.

(Continued)

*Primary Examiner* — Kenneth L Thompson
(74) *Attorney, Agent, or Firm* — Kilpatrick Townsend & Stockton LLP

(57) ABSTRACT

A system includes a processing device and a non-transitory computer-readable medium having instructions stored thereon that are executable by the processing device to cause the system to perform operations. The operations include generating and running a reservoir simulation model. The reservoir and simulation model includes representative natural fracture or secondary porosity attributes for an area of interest for one or more wells. The operations also include generating a synthetic G-function response using results of the reservoir simulation model. Additionally, the operations include calibrating the synthetic G-function response from the reservoir simulation model to a field G-function response generated using results of a field diagnostic fracture injection test by changing natural fracture characteristics of the (Continued)

reservoir simulation model. Further, the operations include formulating a drilling plan, a completion plan, or both for a wellbore in the area of interest using the synthetic G-function response.

19 Claims, 10 Drawing Sheets

(51) Int. Cl.
*E21B 43/26* (2006.01)
*E21B 44/02* (2006.01)

(56) References Cited

U.S. PATENT DOCUMENTS 7,565,278 B2 * 7/2009 Li ..... G06F 30/23 703/2
8,521,494 B2 * 8/2013 Narr ..... G06F 30/23 702/6
9,725,987 B2 * 8/2017 Wutherich ..... E21B 49/006
9,790,788 B2 * 10/2017 Moos ..... E21B 49/008
10,753,181 B2 * 8/2020 Roussel ..... E21B 41/0092
11,156,063 B2 * 10/2021 El Kholy ..... E21B 41/0092
2009/0250211 A1 10/2009 Craig
2010/0218941 A1 * 9/2010 Ramurthy ..... E21B 43/26 166/250.1
2016/0145976 A1 5/2016 Walters et al.
2016/0186532 A1 6/2016 Wang et al.
2018/0134946 A1 5/2018 Mcdaniel
2018/0149000 A1 5/2018 Roussel et al.
2019/0010789 A1 * 1/2019 Beato ..... E21B 49/087

OTHER PUBLICATIONS

Kumar et al., "Comparative Analysis of Dual Continuum and Discrete Fracture Simulation Approaches to Model Fluid Flow in Naturally Fractured, Low-Permeability Reservoirs", SPE-180221-MS, Society of Petroleum Engineers, May 5-6, 2016, pp. 1-27.
Lomask et al., "A Seismic to Simulation Unconventional Workflow Utilizing Automated Fault Detection Attributes", Interpretation, vol. 5, No. 3, 2017, pp. 1-27.
Nolte, "Fracturing-Pressure Analysis for Nonideal Behavior", SPE-20704-PA, Society of Petroleum Engineers, Journal of Petroleum Technology, vol. 43, No. 2, Feb. 1991, pp. 210-218.
International Application No. PCT/US2019/048310, International Search Report and Written Opinion, dated Dec. 16, 2019, 12 pages.

* cited by examiner

WELL OPERATIONS INVOLVING SYNTHETIC FRACTURE INJECTION TEST

CROSS-REFERENCE TO RELATED APPLICATION

This claims priority to U.S. Ser. No. 62/734,428, titled "Well Operations Involving Synthetic Diagnostic Fracture Injection Test" and filed Sep. 21, 2018, the entirety of which is incorporated herein by reference.

BACKGROUND

In some reservoirs, whether sandstones, carbonates, or shales, natural fractures often contribute significantly to hydrocarbon fluid recovery. Characterizing natural fractures can be useful to understand the reservoirs better so that an optimal field development plan can be developed. Ultratight reservoirs have very low permeability and often no well productivity can exist without natural fractures. Because of the complexity and expense to do so, the natural fractures for these types of reservoirs may not be capable of being characterized, which can complicate decisions on well spacing and fracturing operation methods. Moreover, due to lack of tools, it can be difficult to quantify the impact of natural fractures on production, even though natural fractures can be a significant factor in fluid flow during production.

DETAILED DESCRIPTION

Figure 1:
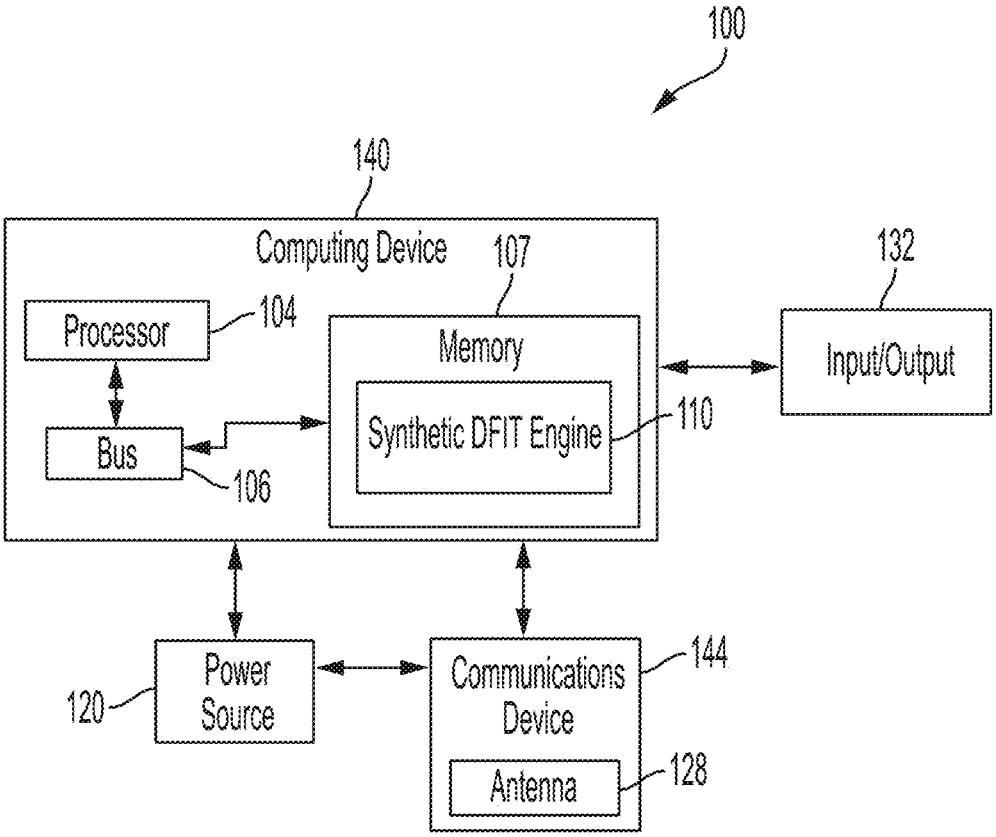
FIG. 1 is a block diagram of a system that can be used to perform a synthetic fracture test process to optimize wellbore planning for a reservoir according to one example of the present disclosure.

Certain aspects and features relate to developing a field for well operations to recover hydrocarbon fluid by characterizing natural fractures, such as those in tight and ultratight formations, using data from diagnostic fracture injection tests (DFITs). DFIT may also be referred to as minifrac, mini falloff, data frac, or injection falloff. A DFIT can involve injecting small quantities of fluid—such as a few barrels of water or brine—into a reservoir to create a limited fracture, and then measuring the pressure falloff over the course of one to several days. Representations of natural fractures in a reservoir simulation model can be tuned using DFIT data so that the simulated or predicted pressure response of the natural fractures matches an existing DFIT data profile. The natural fractures that match the actual DFIT response most closely can represent the effective natural fracture network present in the reservoir being considered, and can be used to plan well drilling, completion, and operations in a field in an optimized manner. Specifically, the design of the hydraulic fracture job can be altered based on the results.

Characterizing natural fractures can be a very expensive and time-consuming process that involves the use of multiple sources of data, such as image logs, cores, analog outcrops, etc. Using DFIT data to characterize natural fractures can provide an indication of the presence of natural fractures through an indication of pressure-dependent leakoff (PDL) in a G-function plot (G*dP/dG vs G). However, a PDL bump in the G-function plot associated with the presence of natural fractures can arise from reasons other than the natural fractures themselves, and tying the nature of the PDL bump seen on the G-function plot or parameters derived from it can be difficult. As used herein, the term G-function may refer to a function that is derived in such a manner that a cumulative volume of fluid leaked off from a fracture after shut-in is linearly proportional to the function.

In some DFIT plots (e.g., G-function plots), a concave-up trend often referred to as fracture height recession may be present and may be caused by impermeable rock that permits essentially no leakoff before closure. An indication of fracture height recession on a DFIT can imply that hydraulic fractures penetrated an interval lacking both matrix permeability and connected natural fractures. Both of these types of leakoffs can be modeled using traditional reservoir simulators (such as Nexus® from Landmark), even without integrated modeling of initiation and growth of hydraulic fractures through a fracture simulator (such as Gohfer®, Fracpro®, and StimPlan®). The simulated DFIT process may not be limited to a single minifrac operation. Tests, such as step-rate tests that include a series of minifrac operations can be simulated by the same tools and using the same underlying process.

Synthetic DFIT can extend application of DFIT by tying it to newer technology, such as fracture productivity software (e.g., DecisionSpace® Fracture Productivity from Landmark). Source-rock reservoirs and other ultratight reservoirs have such small permeabilities (often 10-500 nanodarcies) that the reservoirs may be unable to produce without natural fractures. To be economically viable, the rock may need to have extensive natural fracture networks connected to the hydraulic fractures. However, very little is typically known about this network. Having a better understanding of the characteristics of the natural fracture networks in these ultra-tight formations can help in planning optimized horizontal well locations and fracturing designs, and increase well productivity. Combining characterization of natural fractures with commonly used techniques for geomechanical analysis and system permeability estimates can be used to select the best azimuth in which to drill productive horizontal wells for hydraulic fracturing. To maximize productivity of horizontal wells after hydraulic fracturing, horizontal wells can be drilled parallel to the minimum horizontal stress direction for wells with very low system permeability (e.g., less than about 0.1 md), and horizontal wells can be drilled parallel to the maximum horizontal stress direction for wells with system permeability greater than about 0.1 md.

Using big data capabilities within the context of a Hadoop database, the synthetic DFIT can be implemented at a wide scale so that data from hundreds or even thousands of field DFITs can be leveraged to create a knowledge database of natural fracture characterizations in various basins and places around the world, to be used in support of reservoir planning, such as hydraulic fracturing optimization. Other data sources for natural fracture characterization can be used in conjunction with synthetic DFIT analysis to improve the quality of results.

In an example, natural fracture modeling for simulation can be automated. The PDL shape can be causally related to fracturing parameters calculated from the G-function plot if only the PDL shape is obtained when the natural fractures of specific characteristics are present in the simulation model for the synthetic DFIT. Calculated fracturing parameters can be corrected or rationalized with those derived from a geomechanical model for the same DFIT data. Geomechanical effects can be captured using a coupled reservoir simulator, which can solve for stress and strains in addition to pressure and saturations.

In one example, a synthetic DFIT process includes a pre-calibration process to a fracturing job data sub-process and an application of a calibrated system to a production data sub-process. The pre-calibration to the fracturing job data sub-process can include a system creating a reservoir simulation model with representative known natural fracture or secondary porosity attributes. The simulation model can be integrated to the G-function analysis for the well of interest so that the simulation results and synthetic G-function plots can be generated and analyzed automatically. The G-function response can be matched to the fracturing job data by tuning natural fracture characteristics in the simulation model to calibrate the natural fracture and reservoir inputs to the G-function response. The result can be a calibrated system usable to simulate natural fractures for a well of interest.

The application of the calibrated system to a production data sub-process can include using the simulation model with pre-calibrated natural fracture attributes to match historical production data.

The results from the simulation model can be used to formulate and execute a plan for a wellbore in a reservoir. For example, the simulation model can be used to: plan the location and azimuth of one or more wellbores in the reservoir; decide whether to case the well or to use swell packers; select one or more fracturing techniques to apply to the wellbores; determine the fracture design (e.g., how much fracturing fluid, types and quantity of proppants, and pressure to use with the techniques); or any combination thereof. The wellbores can then be drilled and completed according to the plan.

The G-function is a dimensionless time function relating shut-in time (t) to total pumping time (tp) at an assumed constant rate. G-function calculations can be based on the following relationships:

$$G(\Delta t_D) = \frac{4}{\pi}(g(\Delta t_D) - g_0) \quad \text{(Equation 1)}$$

$$g(\Delta t_D) = \frac{4}{3}((1+\Delta t_D)^{1.5} - \Delta t_D^{1.5}); \text{ for } \alpha = 1 \quad \text{(Equation 2)}$$

$$g(\Delta t_D) = (1+\Delta t_D)\sin^{-1}((1+\Delta t_D)^{-0.5}) + \Delta t_D^{0.5}; \text{ for } \alpha = 0.5 \quad \text{(Equation 3)}$$

$$\Delta t_D = \frac{(t - t_p)}{t_p} \quad \text{(Equation 4)}$$

$$g_0 = \frac{4}{3} \text{ for } \alpha = 1 \quad \text{(Equation 5)}$$

$$g_0 = \frac{\pi}{2} \text{ for } \alpha = 0.5 \quad \text{(Equation 6)}$$

Equation 2 for $\alpha$=1.0 is for low leakoff, or high efficiency, where the fracture area open after shut-in varies approximately linearly with time. Equation 3 for $\alpha$=0.5 is for high leakoff, or low efficiency fluids where the fracture surface area varies with the square root of time after shut-in. The value of $g_0$ is the computed value of g at shut in.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a block diagram of a system 100 that can be used to perform a synthetic DFIT process to optimize wellbore planning for a reservoir according to one example of the present disclosure. In some examples, the components shown in FIG. 1 (e.g., the computing device 140, power source 120, and communications device 144) can be integrated into a single structure. For example, the components can be within a single housing. In other examples, the components shown in FIG. 1 can be distributed (e.g., in separate housings) and in electrical communication with each other.

The system 100 includes a computing device 140. The computing device 140 can include a processor 104, a memory 107, and a bus 106. The processor 104 can execute one or more operations of computer program code instructions for implementing a synthetic DFIT engine 110 that can result in simulated models usable to generate and execute a wellbore plan. The processor 104 can execute instructions stored in the memory 107 to perform the operations. The processor 104 can include one processing device or multiple processing devices. Non-limiting limiting examples of the processor 104 include a Field-Programmable Gate Array ("FPGA"), an application-specific integrated circuit ("ASIC"), a microprocessor, etc.

The processor 104 can be communicatively coupled to the memory 107 via the internal bus 106. The non-volatile memory 107 may include any type of memory device that retains stored information when powered off. Non-limiting examples of the memory 107 include electrically erasable and programmable read-only memory ("EEPROM"), flash memory, or any other type of non-volatile memory. In some examples, at least part of the memory 107 can include a medium from which the processor 104 can read instructions. A computer-readable medium can include electronic, optical, magnetic, or other storage devices capable of providing the processor 104 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The system 100 can include a power source 120. The power source 120 can be in electrical communication with the computing device 140 and the communications device 144. In some examples, the power source 120 can include a battery or an electrical cable to a power source. In some examples, the power source 120 can include an AC signal generator. The computing device 140 can operate the power source 120 to apply a transmission signal to the antenna 128. For example, the computing device 140 can cause the power source 120 to apply a voltage with a frequency within a specific frequency range to the antenna 128. This can cause the antenna 128 to generate a wireless transmission. In other examples, the computing device 140, rather than the power source 120, can apply the transmission signal to the antenna 128 for generating the wireless transmission.

The system 100 can also include the communications device 144. The communications device 144 can include or can be coupled to the antenna 128. In some examples, part of the communications device 144 can be implemented in software. For example, the communications device 144 can include instructions stored in memory 107. The communications device 144 can receive signals from remote devices and transmit data to remote devices (e.g., a wellbore-planning system if separate from system 100). For example, the communications device 144 can transmit wireless or wired communications that are modulated by data via the antenna 128. In some examples, the communications device 144 can receive signals (e.g., associated with data to be transmitted) from the processor 104 and amplify, filter, modulate, frequency shift, and otherwise manipulate the signals. In some examples, the communications device 144 can transmit the manipulated signals to the antenna 128. The antenna 128 can receive the manipulated signals and responsively generate wireless communications that carry the data.

The system 100 can receive input from sensor(s) or historical data sources. System 100 in this example also includes input/output interface 132. Input/output interface 132 can connect to a keyboard, pointing device, display device, and other computer input/output devices. An operator may provide input using the input/output interface 132. An operator may also view an advisory display of set points or other information such as a dashboard on a display screen included in input/output interface 132.

Figure 2:
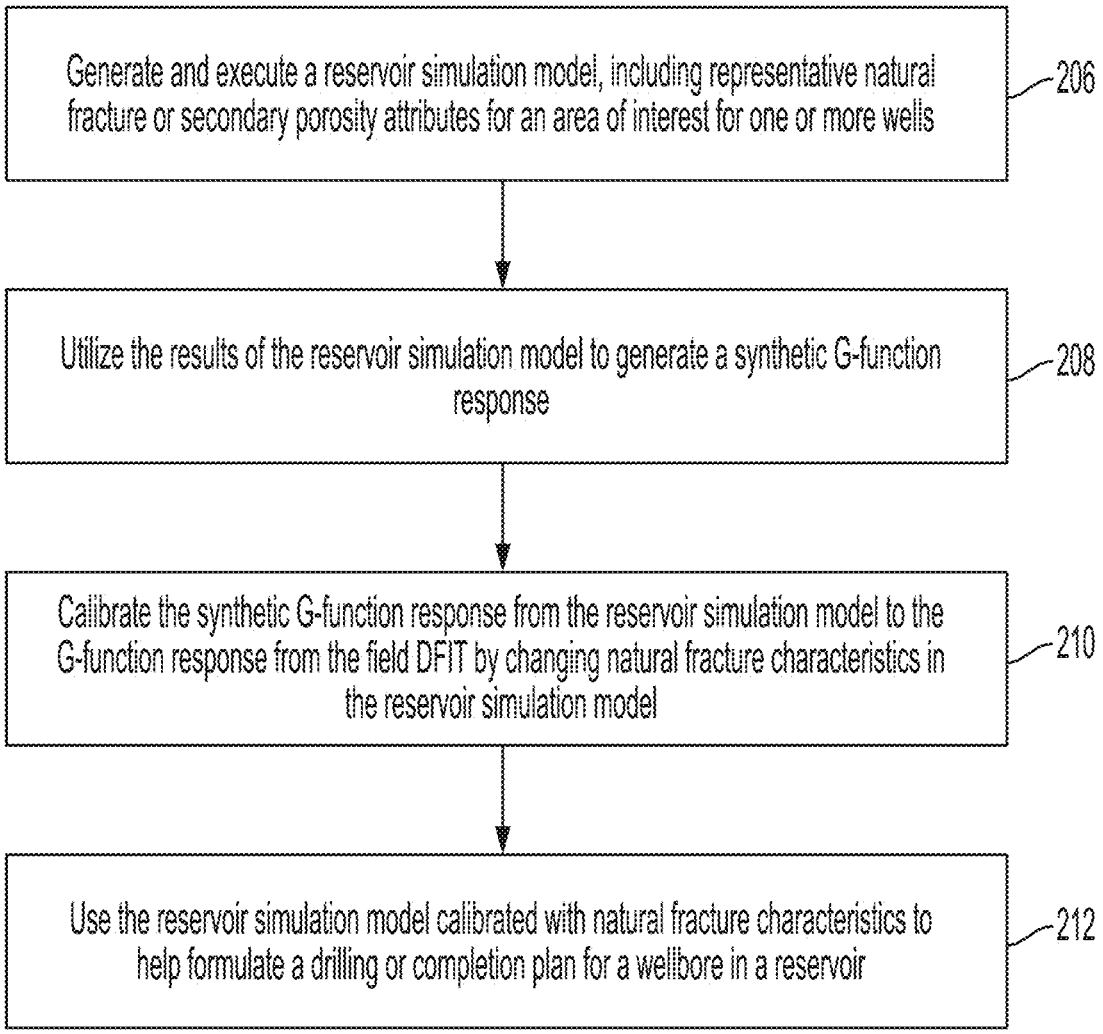
FIG. 2 is a flowchart of a process for applying a synthetic fracture test process to determine a plan for a wellbore in a reservoir of interest according to one example of the present disclosure.

FIG. 2 is a flowchart of a process for applying a synthetic DFIT process to determine a drilling or completion plan for a wellbore in a reservoir of interest according to some examples. The process shown in FIG. 2 can be performed using the system 100 in FIG. 1, though other implementations are possible.

In block 206, a reservoir simulation model, which can also be referred to as a dynamic model, a hydrodynamic model, or a reservoir model, with representative known natural fracture or secondary porosity attributes is identified. The model can be identified by being selected from stored models or by being created using a system such as the system in FIG. 1. The reservoir simulation model can be created using subsurface data from various sources integrated into the reservoir simulation model. These sources may be the result of an exhaustive geoscience process, including steps from basin modeling, seismic interpretation, core retrieval and analysis, digital rock scanning, log analysis, geological structural modeling, or geological property modeling (with or without geostatistical techniques) combined with reservoir fluid. Alternatively, the reservoir simulation model can be extracted from an existing earth model, which can be referred to as a geological model or a static model, or from an existing reservoir simulation model covering a large area. In another alternative, the reservoir simulation model can be based on an analog from the same or geographically separate hydrocarbon field. The reservoir simulation model can contain data on fluid (e.g., pressure, volume, and temperature), rock-fluid properties (e.g., relative permeabilities and capillary pressure relationships), and initial conditions for the simulation—either as equilibrium or non-equilibrium conditions.

This initial or base simulation model can be very close in properties to the region of the reservoir being modeled except perhaps for the natural fracture characterization, which can be the subject of further tuning of the reservoir simulation model in block 210. Since asset teams in oil and gas companies typically maintain a simulation model for various reservoirs under their management, generally through periodic history matching, a suitable initial model can be created from such a model or by extracting a sector out of this model.

The reservoir simulation model can model natural fractures, either in an explicit fashion (e.g., through unstructured or structured gridding) or through a dual continuum method. While the dual continuum (also commonly called "dual porosity") model can be used to model the reservoir with natural fractures, such a model may not have the flexibility of an unstructured grid-based reservoir simulation model. The unstructured gridding can allow modeling the geometries of fractures—hydraulic or natural—to a great amount of detail, and the flow simulated on such a model can capture the gradients of pressures and saturations more accurately. This can be useful in very tight formations because most of the flow in the reservoir is limited to the near-wellbore and near-fracture region locations. Certain aspects of the present disclosure can be practiced with more accuracy using unstructured grids.

Figure 3:
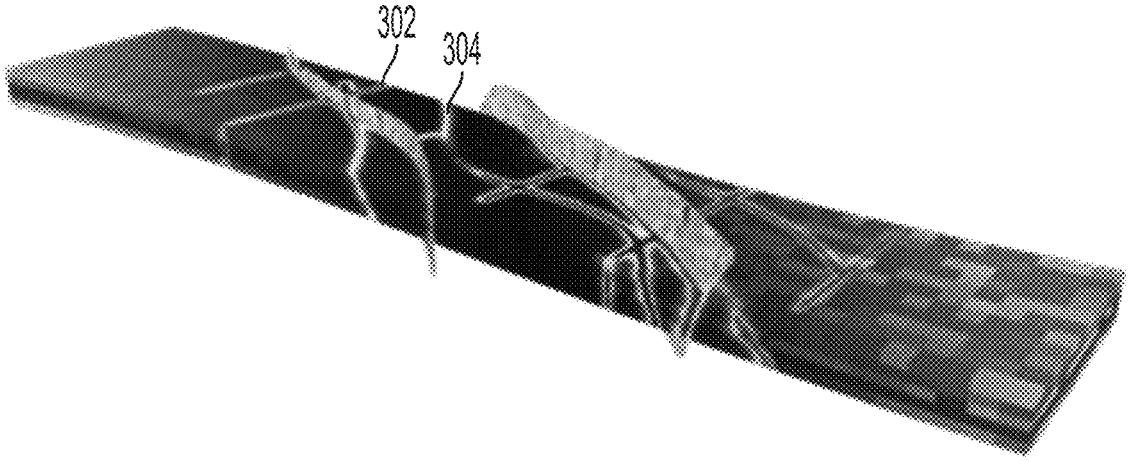
FIG. 3 depicts a model representing hydraulic fractures and natural fractures at physical dimensions according to one example of the present disclosure.

To help illustrate the reservoir simulation model, FIG. 3 depicts an example of a model representing hydraulic fractures and natural fractures at physical dimensions according to one aspect of the present disclosure. The model can provide a high quality prediction of asset productivity on which to base decisions. The example shown in FIG. 3 is a schematic generated by blending two outputs of a simulator. The straight fractures 302 can represent hydraulic fractures. The curved fractures 304 can represent natural fractures. Most flow of fluid within the region depicted in FIG. 3 occurs in and around the fractures 302 and 304.

For more accurate modeling of geomechanical effects in the fracture system, permeability changes with stress can be modeled in a way that the hydraulic fractures, natural fractures, and the matrix can follow the geomechanical effects differently. Being supported by proppant, conductivity of hydraulic fractures reduces less rapidly with decreasing pore pressure than the natural fractures. A matrix can be expected to vary with lithology, and the permeability versus stress functions for the matrix can be different from the permeability versus stress functions of the fractures.

The well trajectory calculated from a deviation survey or otherwise approximated can be entered into the reservoir simulation model. Details of well completion can also be entered to the degree of fidelity required. For example, an indication of a cased hole or an open hole with swell packers may be entered into the reservoir simulation model.

The model can also contain instructions to run the simulation, including the calculation methods, with various settings, tolerances for various solution parameters, pre-conditioners, and solvers. The simulation can be run on a local computer, a high-performance computing (HPC) cluster, or via cloud computing.

Returning to FIG. 2, in block 208, the simulation model is integrated to the G-function analysis for a well of interest to generate synthetic G-function plots for manual or automatic analysis. The simulation model can be executed to create from an output of the simulation model a table of data showing time versus water-injection rate versus flowing bottomhole pressure. These three columns of data can be used to generate the G-function plots. Optionally, the reservoir simulation model may compute the flowing pressures at the wellhead from the flowing bottomhole pressures, using correlations or lift tables. In this case, the flowing wellhead pressures can be calculated by the reservoir simulator without requiring the flowing bottomhole pressure.

In an example with a downhole pressure gauge, the flowing bottomhole pressure can be measured during the actual DFIT. However, in some cases the pressure reading for DFIT is obtained at the wellhead (surface). The simulated DFIT can be completed whether a downhole pressure gauge is used or not. For efficiency, the plots can be automatically generated from simulation results by using computer scripts or by enhancing functionality of the reservoir simulator so that it produces the G-function plot in the form of a table or a chart, as needed.

In block 210, the G-function response is matched to the fracturing job data by tuning natural fracture characteristics in the model to calibrate the natural fracture and reservoir inputs to the G-function response. During the tuning process, a feature of the natural fracture network in the reservoir simulation model is altered and the simulation of the DFIT, which is referred to as synthetic DFIT, is performed so that the G-function calculated from the simulation result matches the G-function of the actual DFIT performed. Mathematically, mismatch between the simulated and actual G-function curves is calculated from the difference of values of the G*dP/dG curve at given intervals of G. The best match can be the minimum value of the sum of squares of these individual error terms. An engineer or other personnel can pre-select weights at different times or points on the curve. These weights can be multiplied with the difference in values for individual error terms, before summation. The weights can provide the flexibility to discard a certain point by applying a weight of zero to points that may not be taken into account for mismatch (e.g., because the data at those points are suspected to be erroneous), or to emphasize or discount matching the curves at certain time-points. In an example, the natural fracture features that can be used to tune the synthetic DFIT response include total surface area, conductivity, orientation profile, density, tightness of clustering (e.g., in tight clusters as opposed to widely spread out), connectivity to the hydraulic fractures, etc.

An alternative tuning method can be used to calculate the mismatch between the simulated DFIT results and the DFIT as performed on the well in the actual field. In this method, the parameters calculated from the G-function can be used to calculate mismatch rather than the mismatch between the entire curves. In this alternative method, an automatic method is used to extract critical parameters, such as the instantaneous shut in pressure (ISIP) and closure stress, as well as secondary parameters, such as net pressure difference, that are derived from the critical parameters. The routines, which can be referred to as pre-closure analysis (PCA), to identify ISIP and closure can be implemented using software. Similar ones can be used in this case. The closure point can be identified by the change in gradients of the G*dP/dG and the dP/dG curves. ISIP can be taken to be the final injection pressure minus the pressure drop caused by friction in the wellbore and any perforations or liner.

The following parameters can be determined from the PCA: fracture closure pressure ($p_c$); Instantaneous Shut-In Pressure (ISIP), which is the final injection pressure minus pressure drop due to friction; ISIP gradient, which is the ISIP divided by the formation depth; closure gradient, which is the closure pressure divided by the formation depth; net fracture pressure ($\Delta p_{net}$), which is the additional pressure within the fracture above the pressure required to keep the fracture open and can be an indication of the energy available to propagate the fracture (e.g., $\Delta p_{net}$=ISIP−$p_c$); G-function time $G_c$ at fracture closure; and fluid efficiency, which is the ratio of the stored volume within the fracture to the total fluid injected. In an example, a high fluid efficiency can mean low leakoff from the formation and can indicate that the energy used to inject the fluid was efficiently utilized in creating and growing the fracture. An indication of low leakoff may also indicate low permeability in the formation. For a minifrac operation, after-closure analysis, high fluid efficiency can be coupled with long closure durations to identify even longer flow regime trends.

Figure 4:
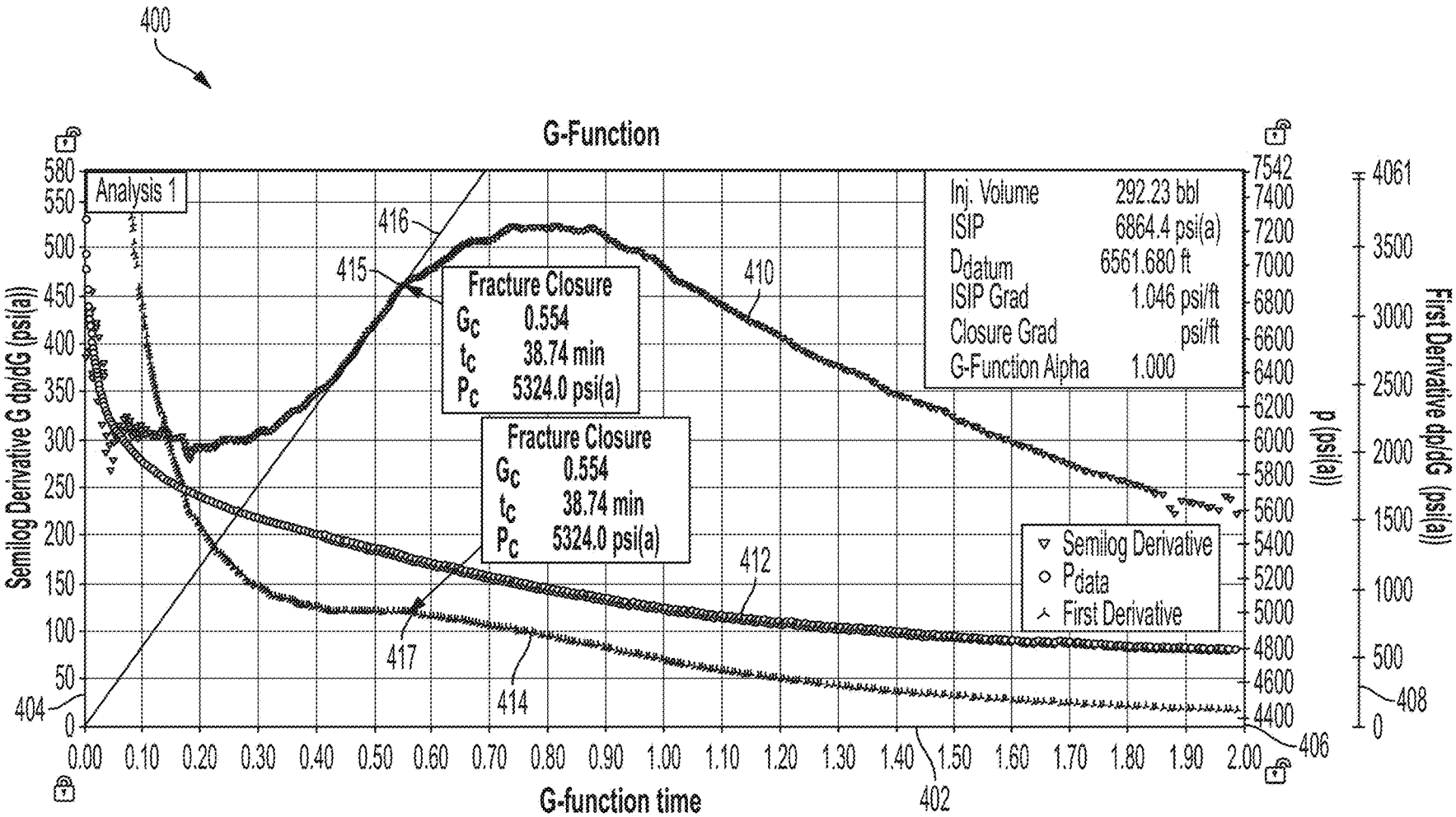
FIG. 4 is an example of a field G-function plot for a fracture test showing primary parameters and calculated parameters according to one aspect of the present disclosure.

To help illustrate, FIG. 4 depicts an example a field G-function plot 400 for a DFIT showing primary parameters and calculated parameters according to one aspect of the present disclosure. An abscissa 402 provides an indication of G-function time ($G_c$), a first ordinate 404 provides an indication of a semilog G-function derivative (G*dP/dG), a second ordinate 406 provides an indication of pressure (p), and a third ordinate 408 provides an indication of a constant pressure derivative (dP/dG). As illustrated, a line 410 represents values of the semilog G-function derivative (i.e., the first ordinate 404) over the G-function time (i.e., the abscissa 402), a line 412 represents values of pressure (i.e., the second ordinate 406) over the G-function time, and a line 414 represents values of the constant pressure derivative (i.e., the third ordinate 408) over the G-function time. A fracture closure point 415 can be identified at a point where the semilog G-function derivative line 410 deviates from a line 416. A fracture closure point 417, which is at the same G-function time as the fracture closure point 415, can also be identified at a point where the constant pressure derivative line 414 provides a change in gradient (e.g., a point where a negative slope of the line 414 increases).

In the alternative method, the primary parameters, ISIP and closure pressure, can be identified for both the simulated DFIT data and the actual DFIT data. The mismatch can be calculated from mismatch between these parameters. An example can include taking the difference between critical pressure from simulated DFIT and critical pressure from the actual DFIT. In the alternative method, only the mismatch value may be calculated differently—the rest of the tuning process can work the same way as in the method first described.

For efficiency, the tuning process may use workflow automation software (such as Decision Management System, DMS™ from Landmark). Given one base reservoir simulation model, this type of software can automate the entire process from changing a natural fracture feature, to running the simulation, gathering the result, calculating and simulating the G-function, calculating the error term, and using an optimizer to select the next change in the natural fracture feature to minimize the error term. In an example, the error term is the objective function of the optimization, subject to customized constraints and bounds on the solution. Multiple inputs of natural fracture sets can produce approximately the same amount of minimal mismatch, and more than one natural fracture set can be the solution of the optimization problem. The tuning process of the DFIT to minimize the mismatch is described in further detail below with respect to FIG. 5.

An optimization model used to minimize the error function can include an objective function (f(x)), decision variables (x), equality constraints (h(x)), and inequality constraints (g(x)). The objective function describes the performance of a system or asset and it is attempted to maximize or minimize the objective function. The decision variables describe decisions that determine performance through the objective function. The equality constraints describe the physical and economic relationships of the system and a process. The inequality constraints restrict values of the decision variables because of operational limitations. The model can be expressed as min (or max): f(x), such that g(x) is less than or equal to zero and h(x) is equal to 0.

Returning to FIG. 2, one or more sets of characterized natural fractures can be obtained by following the process in blocks 206 through 210. These sets, which can have minimal mismatch between the synthetic and field-based DFITs, can constitute the reservoir simulation model. Since these steps provide a reservoir simulation model, tools used for analyzing simulation results through 2D or 3D visualization can be used to interrogate and analyze the simulation results, including the characterized natural fractures. Furthermore, details of the volumes, pressures, saturations, and other fluid and rock properties in various parts of the reservoir can be obtained and analyzed. For example, the amounts of injected fluid leaked off from the hydraulic fracture into the matrix and natural fractures can be reported as a function of time as part of the simulation results.

The pressure falloff period of a minifrac operation can provide estimates of reservoir pressure and overall reservoir permeability. In some tight reservoirs, operational demands can preclude spending the time to complete pressure falloffs after a minifrac operation. However, the synthetic DFIT process as described in blocks 206 through 210 of FIG. 2 may not suffer from such operational limitations. Indeed, even in cases where the field minifrac data is too short for a proper post-closure analysis, the simulated DFIT can be made sufficiently long by running the simulation longer (e.g., by increasing the shut-in period in the simulation model). The G-function obtained in block 208 can include the full data from shut-in to the end of the simulation. Thus, the simulated DFIT can be used to obtain an estimate of reservoir permeability and initial reservoir pressure through post-closure methods. If the estimates vary considerably from the values input into the reservoir simulation model in block 206, the process from block 206 through block 210 can be executed in an iterative fashion until the simulation model at the end of block 210 is consistent with respect to: the simulated G-function and the field minifrac G-function up to the end of the field minifrac operation; the initial reservoir pressures in the reservoir simulation model and the reservoir pressures obtained by post-closure analysis of simulated G-function response; and the reservoir absolute permeability in the reservoir simulation model and the reservoir absolute permeability obtained by post-closure analysis of the simulated G-function response.

In block 212, the simulated results are used to formulate a drilling and completion plan for a wellbore in the reservoir. For example, by combining characterization of natural fractures with techniques for geomechanical analysis and estimation of system permeability, the best azimuth in which to drill productive horizontal wells for hydraulic fracturing can be selected. To maximize productivity of horizontal wells after hydraulic fracturing, in very low system permeability (e.g., less than about 0.1 md) horizontal wells parallel to the minimum horizontal stress direction can be drilled, while for wells with system permeability greater than about 0.1 md, horizontal wells can be drilled parallel to the maximum horizontal stress direction. In practice, block 212 can be applied using different scenarios, some of which are described as follows:

In a first scenario, a vertical pilot well is available, on which a minifrac is performed for DFIT analysis. Following the method described in blocks 206 to 210, drilling and completion plans can be finalized in block 212 based on characterized natural fractures to add a lateral on the pilot well or to drill and complete subsequent horizontal or vertical wells in the area.

In a second scenario, a well has been drilled but not completed, and a minifrac can be performed for DFIT analysis. Following the method described in blocks 206 to 210, completion plans can be finalized in block 212 based on characterized natural fractures to stimulate the well in one or more stages and to similarly drill and complete subsequent horizontal or vertical wells in the area.

In a third scenario, a well has been drilled and completed, including a minifrac for DFIT analysis. Following the method described in blocks 206 to 210, drilling and completion plans can be finalized based on characterized natural fractures for subsequent horizontal or vertical wells in the area.

The completion and hydraulic fracturing plan may include a custom-designed fracturing schedule. For example, if the natural fractures in a tight carbonate reservoir are determined to be very dense and highly conductive, a standard fracturing operation design may result in hydraulic fractures that leak off so quickly into the reservoir that no appreciable hydraulic fracture length is established and the well production declines rapidly. In such a case, a suitable fracturing operation design can be devised to establish a dominant hydraulic fracture, for example by using a combination of a cased, cemented hole with a limited number of perforations, a fine proppant mesh, and viscous fluids to control leak off. In another case in a brittle shale reservoir with natural fractures, completion of the well with swell packers in an open hole and use of slick water may be suitable for successful hydraulic fracturing. In these and other cases, the specifics of the fracturing operation design can be determined based on the results of certain aspects of the present disclosure. Thus, the fracturing operation design may include identifying a suitable casing strategy within the wellbore, a perforation design within the wellbore, proppant mesh sizes, viscosity of fracturing fluid, any other parameters used to control a hydraulic fracturing operation, or any combination thereof.

Figure 5:
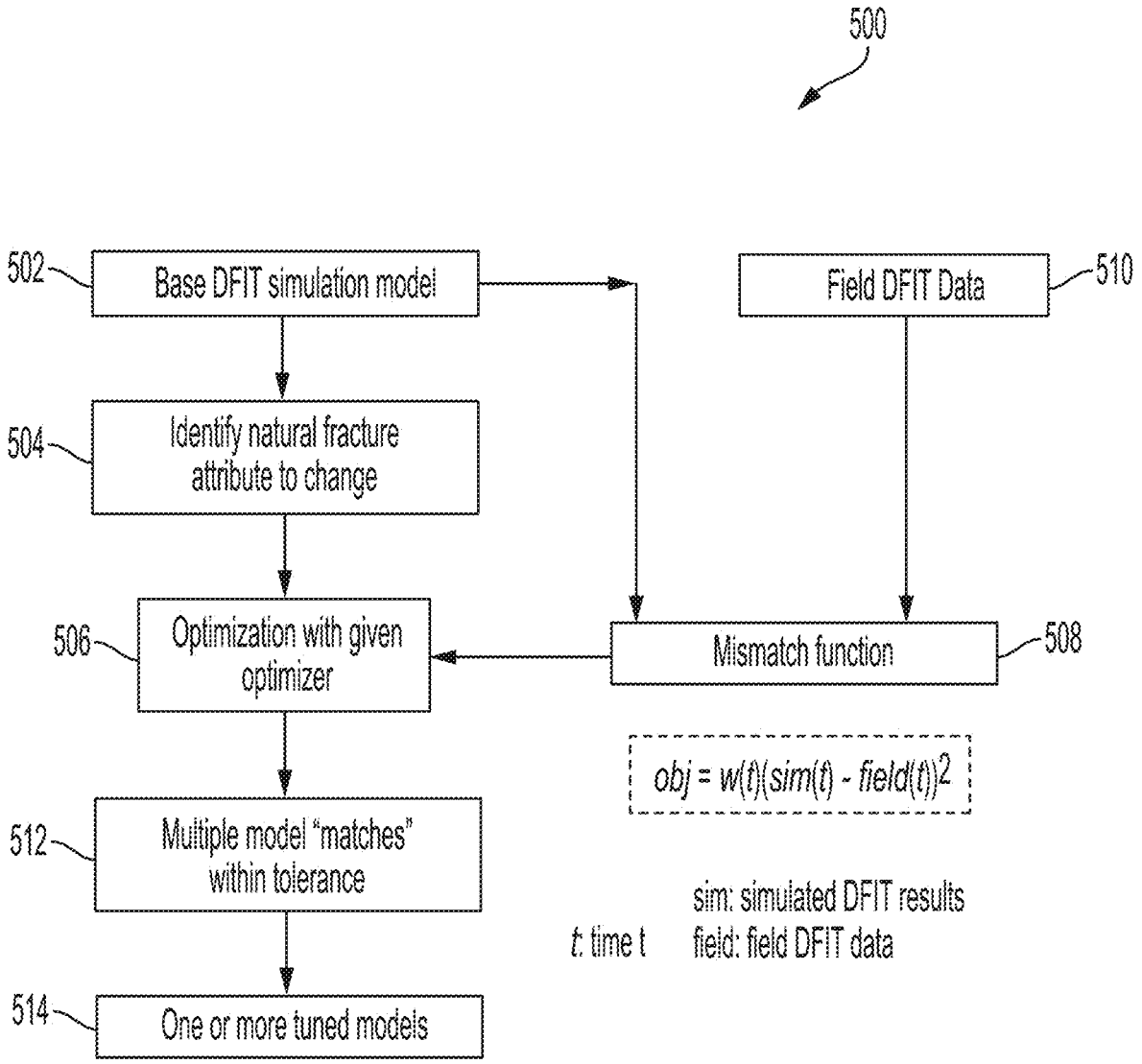
FIG. 5 is a flowchart of a process for tuning a fracture test to minimize the mismatch in an objective function according to one example of the present disclosure.

FIG. 5 is a flowchart of an example of a process 500 for tuning a DFIT to minimize the mismatch in an objective function according to one aspect of the present disclosure. The objective function (shown as "obj" in FIG. 5) can be calculated from the weighted sum of squares of individual error terms at various times t.

In block 502, a base DFIT simulation model is generated. The base DFIT simulation model can be generated using a system, such as the system 100 in FIG. 1. The base DFIT simulation model can represent natural fractures or secondary porosity attributes for an area of interest for one or more wells. The base DFIT simulation model can be used in block 504 to identify a natural fracture attribute in the model to change to provide tuning for the DFIT.

In block 506, the DFIT simulation model can be optimized with a given optimizer from the mismatch function in block 508. The mismatch function, which can represent the objective function (obj), can be determined using the base DFIT simulation model from block 502 and field DFIT data from block 510. The field DFIT data in block 510 can be observed DFIT data from subterranean formations. The objective function can be determined by squaring the result of subtraction of the field DFIT data with respect to time from the simulated DFIT results with respect to time.

In block 512, the system can determine matching models to the optimized simulation model within a pre-set tolerance. For example, multiple inputs of natural fracture sets can produce approximately the same amount of minimal mismatch (i.e., matching within a pre-set tolerance), and more than one natural fracture set can be the solution of the optimization problem. The system can then output one or more tuned models in block 514 based on the natural fracture sets that produce the matching within the pre-set tolerance.

Figure 6:
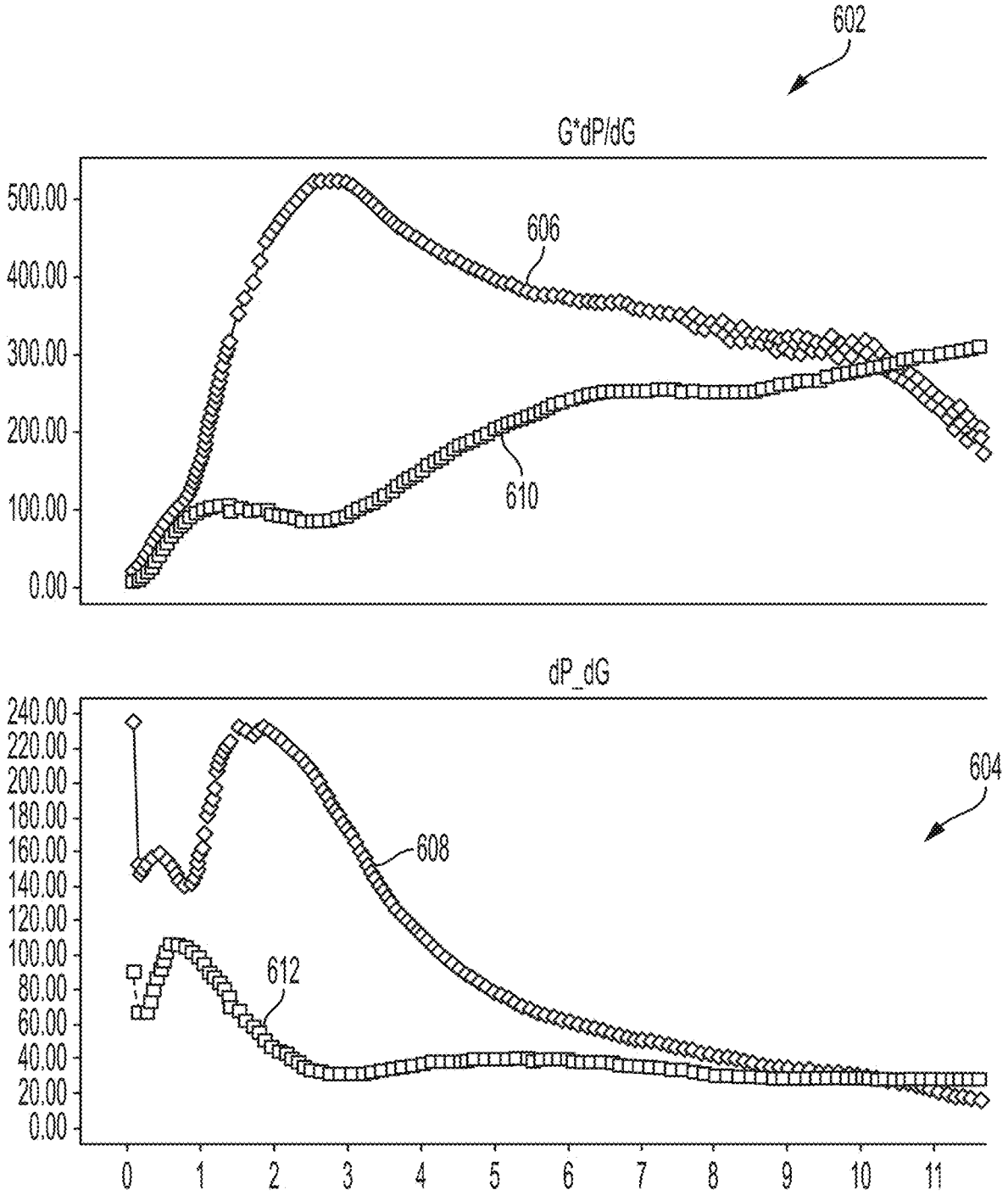
FIG. 6 depicts charts showing two examples of type curves according to some aspects of the present disclosure.

In another approach, a reservoir simulation model is used to develop representative profiles of DFITs for a range of combinations of natural fracture and matrix characteristics. These representative profiles of DFITs can be referred to as type curves. FIG. 6 depicts charts showing two examples of type curves 602 and 604 according to some aspects of the present disclosure. The type curve 602 may represent a G-function derivative over G-function time, and the type curve 604 may represent a constant pressure derivative over G-function time. The DFIT from a well of interest can be matched to the appropriate DFIT type curve to indicate the nature of natural fracture and matrix characteristics. For example, in FIG. 6, curves 606 and 608 represent a case with two sets of natural fractures, and curves 610 and 612 represent a case of only one set of natural fractures. Besides a range of DFIT type curves, inputs to this approach can include fracturing job data and flowing bottom-hole pressures versus injection rate to produce G-function plots, in addition to well information such as the depth of the DFIT. Outputs include ranges of natural fracture characteristics expected to produce the observed DFIT response. This approach can provide a rapid technique to improve hydraulic fracture designs and determine whether to place additional wells in the area of the well.

Figure 7:
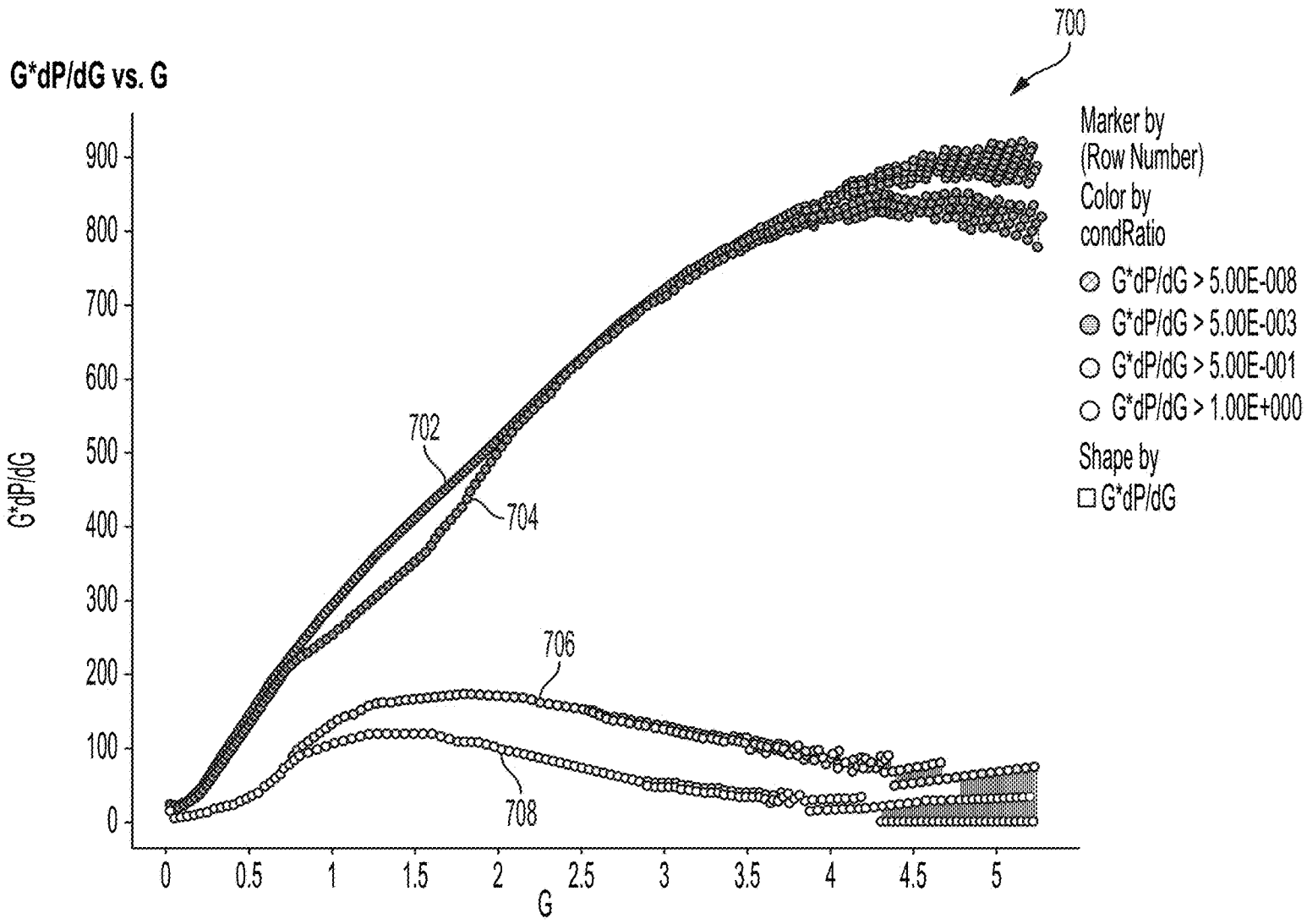
FIG. 7 shows as an example of improving hydraulic fracture design by using derivatives of type curves to enable design of a fracturing job to achieve a suitable natural-fracture-to-hydraulic-fracture conditioning ratio according to one aspect of the present disclosure.

As an example of improving hydraulic fracture design, the use of derivatives of type curves can enable design of a fracturing job to achieve a suitable natural-fracture-to-hydraulic-fracture conditioning ratio as depicted in FIG. 7. For example, FIG. 7 includes a chart 700 representing a G-function derivative over the G-function. Curves 702 and 704 of the chart 700 represent a case where a conditioning ratio of natural fractures to hydraulic fractures is low. Further, curves 706 and 708 depict a case where a higher conditioning ratio of natural fractures to hydraulic fractures is present. The impact of the conditioning ratios on expected production from a well help drive a design of suitable hydraulic fracture treatments.

Figure 8:
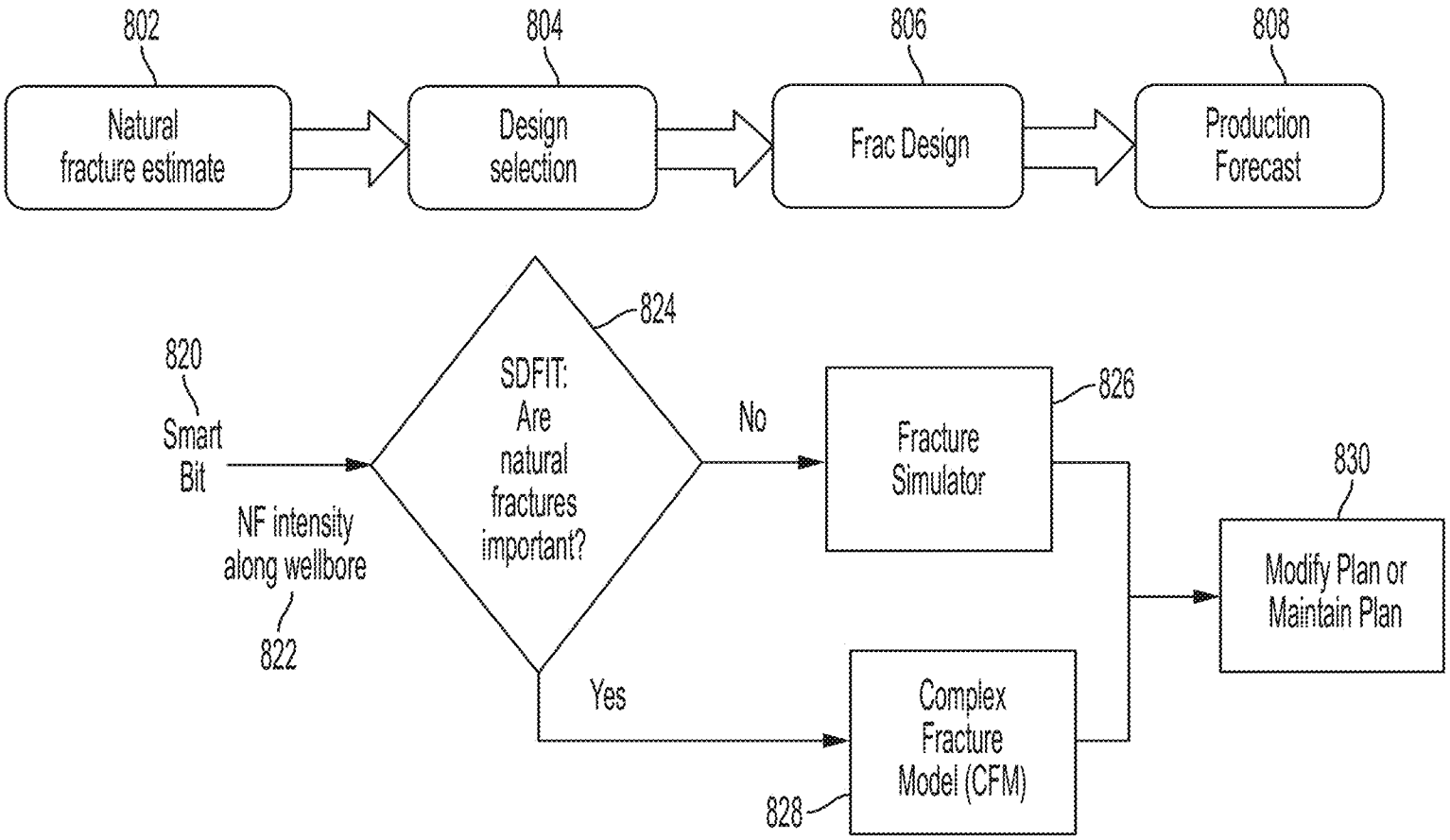
FIG. 8 depicts a first workflow for using a synthetic fracture test for designing hydraulic fractures in cases where limited drilling and petrophysical data are available according to one aspect of the present disclosure.

FIG. 8 depicts a first workflow for using synthetic DFITs for designing hydraulic fractures in cases where limited drilling and petrophysical data are available according to one aspect of the present disclosure. In block 802, a natural fracture network is estimated. The natural fracture network may be estimated from samples extracted from a potential well site. Based on the natural fractures present in the sample, the natural fracture network can be estimated based on the size of the formation associated with the potential well site.

In block 804, a design for a well can be selected using the natural fracture estimate. For example, completion tools and parameters, and placement of different tools and well treatments, can be selected to work best with a particular natural fracture estimate. Based on the selected design or designs for the well, a recommended fracturing design can be formulated in block 806. The fracturing design can account for natural fractures likely to be present in the well and leverage the presence of those fractures for maximizing hydrocarbon production and well life. Using the recommended fracturing design, a production forecast can be generated for the potential well site in block 808. The production forecast may represent an estimate of hydrocarbon production from the well upon implementing the well design selected in block 804 and completing the fracturing design recommended in block 806.

The design selection can be used to control a smart bit 820 for drilling a wellbore at a well site according to the drilling plan. The smart bit 820 can also measure the natural fracture, or NF, intensity along the wellbore 822 while drilling the well. The measurements can be used to determine whether natural fractures are important for production in the well of interest in block 824. If the natural fractures are not important, a fracture simulator (such as Gohfer®, Fracpro®, and StimPlan®) can be executed on the fracturing design in 826 to determine whether to modify the fracturing plan or to maintain the plan in block 830. If the natural fractures are important, a complex fracture model can be executed at 828 using both the natural fracture intensity along the wellbore and the fracturing design to determine whether to modify the fracturing plan or to maintain the fracturing plan in block 830.

Figure 9:
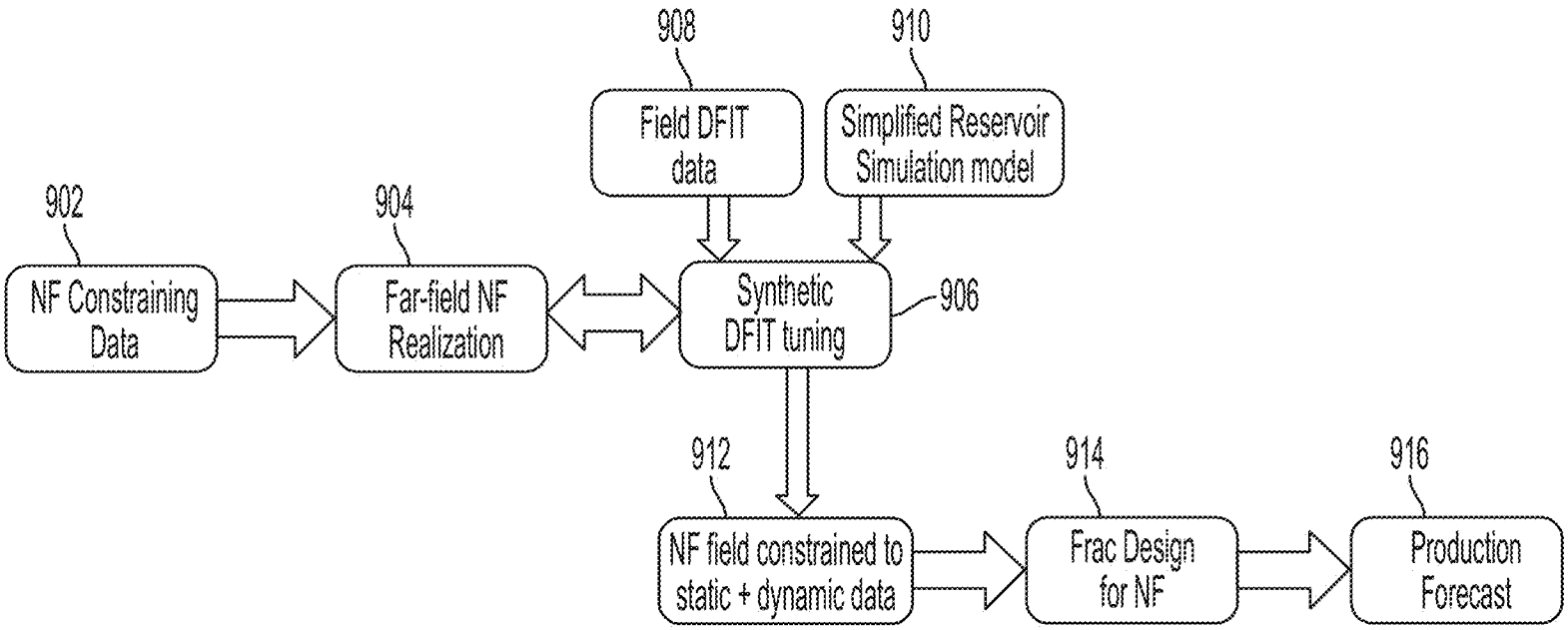
FIG. 9 depicts a second workflow for using synthetic diagnostic fracture injection tests (DFITs) for designing hydraulic fractures in cases where constraining drilling and petrophysical data exist according to one aspect of the present disclosure.

FIG. 9 depicts a second workflow for using synthetic DFITs for designing hydraulic fractures in cases where constraining drilling and petrophysical data exist according to one aspect of the present disclosure. The constraining drilling and petrophysical data can indicate the presence of natural fractures, such as through image logs, smart bits, or cores.

In block 902, natural fracture, or NF, constraining data are received. The natural fracture data can be detected along the wellbore and be combined with a grid indicating the likelihood spread of the natural fractures. The natural fracture constraining data can be used in a natural fracture network generator to generate a far-field natural fracture realization in block 904. In the far-field natural fracture realization, natural fractures can be constrained to static data.

In block 906, the far-field natural fracture realization can be tuned via a synthetic DFIT tuning process, such as the tuning process of FIG. 5. The tuning process can use field DFIT data from block 908 and a simplified reservoir simulation model from block 910. The tuning process can be used to calibrate the natural fracture-related parameters in the simulation model to the results of the field DFIT. The tuning process can minimize mismatches between field DFIT data and a model's DFIT response by changing natural fracture attributes.

The output of the tuning process can be natural fracture field information constrained to static and dynamic data in block 912. That data can be used to generate a fracturing design that accounts for the natural fracture network in the formation in block 914. The fracturing design can be used to generate a production forecast for the well in block 916.

Figure 10:
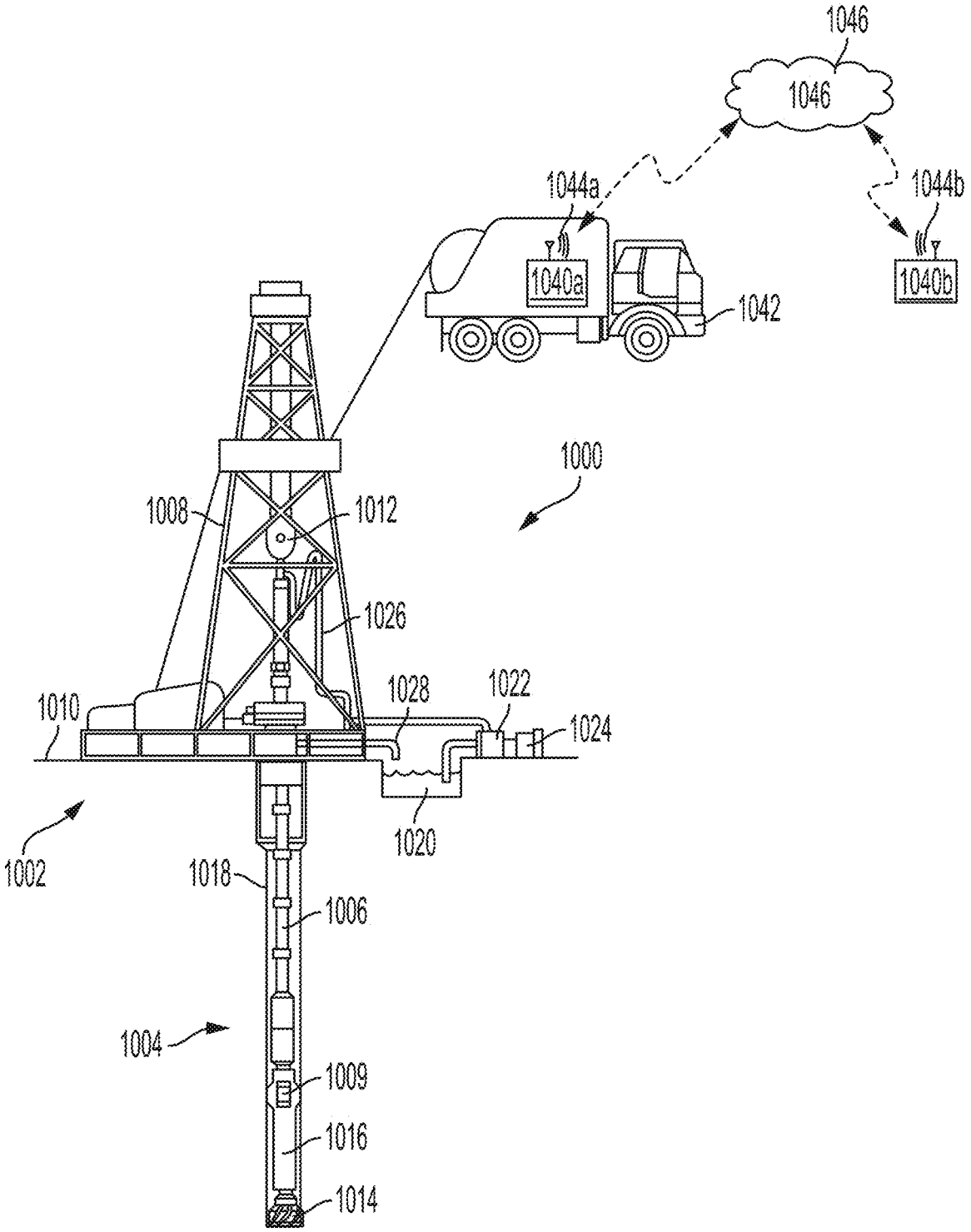
FIG. 10 schematically shows a cross-section of a wellbore being drilled according to a plan generated using a synthetic fracture test model according to one example of the present disclosure.

FIG. 10 schematically shows a cross-section of a wellbore being drilled in a wellbore according to a plan generated using a synthetic DFIT model according to one example of the present disclosure. A wellbore may be created by drilling into the earth 1002 using the drilling system 1000. The drilling system 1000 may be configured to drive a bottom hole assembly (BHA) 1004 positioned or otherwise arranged at the bottom of a drillstring 1006 extended into the earth 1002 from a derrick 1008 arranged at the surface 1010. The derrick 1008 includes a travelling block and drilling line 1012 used to lower and raise the drillstring 1006. The BHA 1004 may include a drill bit 1014 operatively coupled to a tool string 1016, which may be moved axially within a drilled wellbore 1018 as the attached drillstring 1006. The tool string 1016 may include one or more sensors 1009 to determine conditions of the drill bit and wellbore, and return values for various parameters to the surface through cabling (not shown) or by wireless signal. The combination of any support structure (in this example, derrick 1008), any motors, electrical connections, and support for the drillstring and tool string may be referred to herein as a drilling arrangement.

During operation, the drill bit 1014 penetrates the earth 1002 and thereby creates the wellbore 1018. The BHA 1004 provides control of the drill bit 1014 as it advances into the earth 1002. Fluid or "mud" from a mud tank 1020 may be pumped downhole using a mud pump 1022 powered by an adjacent power source, such as a prime mover or motor 1024. The mud may be pumped from the mud tank 1020, through a stand pipe 1026, which feeds the mud into the drillstring 1006 and conveys the same to the drill bit 1014. The mud exits one or more nozzles (not shown) arranged in the drill bit 1014 and in the process cools the drill bit 1014. After exiting the drill bit 1014, the mud circulates back to the surface 1010 via the annulus defined between the wellbore 1018 and the drillstring 1006, and in the process returns drill cuttings and debris to the surface. The cuttings and mud mixture are passed through a flow line 1028 and are processed such that a cleaned mud is returned down hole through the stand pipe 1026 once again.

Still referring to FIG. 10, the drilling arrangement and any sensors 1009 (through the drilling arrangement or directly) are connected to a computing device 1040*a*. In FIG. 9, the computing device 1040*a* is illustrated as being deployed in a work vehicle 1042, however, a computing device to receive data from sensors 1009 and control drill bit 1014 of the drilling tool can be permanently installed with the drilling arrangement, be hand-held, or be remotely located. In some examples, the computing device 1040*a* can process at least a portion of the data received and can transmit the processed or unprocessed data to another computing device 1040*b* via a wired or wireless network 1046. In some examples, the connection between the two computing devices is through a real time message bus (RTMB). The other computing device 1040*b* can be offsite, such as at a data-processing center or be located near computing device 1040*a*. Either or both computing device can execute computer program code instructions that enable a processor to implement a drilling plan. The computing devices 1040*a-b* can include a processor interfaced with other hardware via a bus and a memory, which can include any suitable tangible (and non-transitory) computer-readable medium, such as RAM, ROM, EEPROM, or the like, can embody program components that configure operation of the computing devices 1040*a-b*. In some aspects, the computing devices 1040*a-b* can include input/output interface components (e.g., a display, printer, keyboard, touch-sensitive surface, and mouse) and additional storage.

The computing devices 1040*a-b* can include communication devices 1044*a-b*. The communication devices 1044*a-b* can represent one or more of any components that facilitate a network connection. In the example shown in FIG. 10, the communication devices 1044*a-b* are wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication devices 1044*a-b* can use acoustic waves, surface waves, vibrations, optical waves, or induction (e.g., magnetic induction) for engaging in wireless communications. In other examples, the communication devices 1044*a-b* can be wired and can include interfaces such as Ethernet, USB, IEEE 1394, or a fiber optic interface. The computing devices 1040*a-b* can receive wired or wireless communications from one another and perform one or more tasks based on the communications. These communications can include communications over the RTMB, which may be implemented virtually over any kind of physical communication layer.

Subsequent to drilling, the wellbore 1018 can be completed in accordance with the plan developed using synthetic DFIT simulation, as discussed above with respect to blocks 212, 804, 806, and 914. For example, the fracturing process and technique can be selected and implemented in the wellbore 1018 in accordance with the plan.

The following is an example of simulating a reservoir using the synthetic DFIT process according to one aspect. A simulation can be executed in which a hydraulic fracture operation can inject fracturing fluid at a constant rate, such as 250 b/d for 0.5 days. This can be followed by a shut-in for 3.5 days. At four days of the simulation (i.e., 3.5 days of leak-off), a large portion of the reservoir may still be pressurized.

Using the readings from the hydraulic fracture operation, the leak-off process from the hydraulic fracture fluid into a naturally fractured reservoir can be simulated. For example, the readings from the wellbore can show a PDL-type behavior in a G-function plot. The link between the natural fracture characteristics and the G-function response can be defined with greater accuracy using the synthetic DFIT process. Further, the synthetic DFIT process can be used to analyze how the hydraulic fracture operation and reservoir properties affect the leak-off response.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

In some aspects, systems, devices, and methods developing a field for well operations to recover hydrocarbon fluid by characterizing natural fractures are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processing device; and a non-transitory computer-readable medium having instructions stored thereon that are executable by the processing device to cause the system to perform operations, the operations comprising: generating and running a reservoir simulation model, including representative natural fracture or secondary porosity attributes for an area of interest for one or more wells; generating a synthetic G-function response using results of the reservoir simulation model; calibrating the synthetic G-function response from the reservoir simulation model to a field G-function response generated using results of a field diagnostic fracture injection test by changing natural fracture characteristics of the reservoir simulation model; and formulating a drilling plan, a completion plan, or both for a wellbore in the area of interest using the synthetic G-function response.

Example 2 is the system of example 1, wherein the instructions are further executable by the processing device to cause the system to perform operations comprising: controlling a drill bit or a fracturing operation using the drilling plan, the completion plan, or both for the wellbore in the area of interest.

Example 3 is the system of examples 1-2, wherein the synthetic G-function response comprises a maximum horizontal stress direction and a minimum horizontal stress direction for the area of interest, and wherein the instructions are further executable by the processing device to cause the system to perform operations comprising: controlling a drill bit along a first drilling azimuth that is parallel to a minimum horizontal stress direction for the area of interest with a system permeability less than 0.1 millidarcy, or controlling the drill bit along a second drilling azimuth that is parallel to a maximum horizontal stress direction for the area of interest with system permeability greater than 0.1 millidarcy.

Example 4 is the system of examples 1-3, wherein formulating the drilling or completion plan comprises identifying a drilling azimuth for drilling the wellbore.

Example 5 is the system of examples 1-4, wherein formulating the drilling or completion plan comprises identifying a suitable casing status of the wellbore, a suitable perforation design within the wellbore, suitable proppant mesh sizes, a suitable viscosity of fracturing fluid, or any combination thereof.

Example 6 is the system of examples 1-5, wherein the synthetic G-function response identifies a fracture closure pressure, an Instantaneous Shut-In Pressure (ISIP), an ISIP gradient, a net fracture pressure, a G-function time at fracture closure, a fluid efficiency within a natural fracture, or any combination thereof.

Example 7 is the system of examples 1-6, wherein the synthetic G-function response comprises an indication of a semilog G-function derivative within the area of interest, an indication of pressure within the area of interest, and an indication of a constant pressure derivative within the area of interest.

Example 8 is the system of examples 1-7, wherein the secondary porosity attributes comprise fluid pressure, fluid volume, fluid temperature, relative formation permeabilities, formation capillary pressure relationships, or a combination thereof.

Example 9 is a method comprising: developing a set of representative type curves of diagnostic fracture injection tests for a range of combinations of natural fracture characteristics and matrix characteristics of a reservoir using a reservoir simulation model; matching a representative profile of a well of interest generated using a field diagnostic fracture injection test with an appropriate type curve of the set of representative type curves to indicate a nature of the natural fracture characteristics and the matrix characteristics; and formulating a drilling plan, a completion plan, or both for a wellbore in the reservoir using the representative profile of the well of interest.

Example 10 is the method of example 9, further comprising: controlling a drill bit or a fracturing operation using the drilling plan, the completion plan, or both for the wellbore in the reservoir.

Example 11 is the method of examples 9-10, wherein the appropriate type curve comprises a maximum horizontal stress direction and a minimum horizontal stress direction for an area of interest of the reservoir, and wherein the method further comprises: controlling a drill bit along a first drilling azimuth that is parallel to a minimum horizontal stress direction for the area of interest with a system permeability less than 0.1 millidarcy, or controlling the drill bit along a second drilling azimuth that is parallel to a maximum horizontal stress direction for the area of interest with system permeability greater than 0.1 millidarcy.

Example 12 is the method of examples 9-11, wherein the appropriate type curve comprises a type curve from the set of representative type curves that best fits a field type curve of the representative profile of the well of interest.

Example 13 is the method of examples 9-12, wherein formulating the drilling plan, the completion plan, or both comprises identifying a suitable casing status of the wellbore, a suitable perforation design within the wellbore, suitable proppant mesh sizes, a suitable viscosity of fracturing fluid, or any combination thereof.

Example 14 is the method of examples 9-13, wherein the appropriate type curve identifies a fracture closure pressure, an Instantaneous Shut-In Pressure (ISIP), an ISIP gradient, a net fracture pressure, a G-function time at fracture closure, a fluid efficiency within a natural fracture, or any combination thereof.

Example 15 is the method of examples 9-14, wherein formulating the completion plan comprises determining a suitable natural-fracture-to-hydraulic-fracture conditioning ratio.

Example 16 is a non-transitory computer-readable medium that includes instructions that are executed by a processing device to perform operations, the operations comprising: generating and running a reservoir simulation model, including representative natural fracture or secondary porosity attributes for an area of interest for one or more wells; generating a synthetic G-function response using results of the reservoir simulation model; and calibrating the synthetic G-function response from the reservoir simulation model to a field G-function response generated using results of a field diagnostic fracture injection test by changing natural fracture characteristics of the reservoir simulation model.

Example 17 is the non-transitory computer-readable medium of example 16, the operations further comprising:

formulating a drilling plan, a completion plan, or both for a wellbore in the area of interest using the synthetic G-function response.

Example 18 is the non-transitory computer-readable medium of examples 16-17, the operations further comprising: controlling a drill bit or a fracturing operation using the synthetic G-function response.

Example 19 is the non-transitory computer-readable medium of example 18, wherein controlling the drill bit comprises controlling the drill bit along an azimuth for drilling a wellbore.

Example 20 is the non-transitory computer-readable medium of example 18, wherein controlling the fracturing operation comprises implementing a suitable casing strategy within a wellbore, controlling a perforation design within the wellbore, controlling a proppant mesh size, controlling a viscosity of fracturing fluid, or controlling any combination thereof.

The foregoing description of certain embodiments, including illustrated embodiments, has been presented only for the purpose of illustration and description and is not intended to be exhaustive or to limit the disclosure to the precise forms disclosed. Numerous modifications, adaptations, combinations, and uses thereof are possible without departing from the scope of the disclosure.

What is claimed is:

1. A system comprising:

a processing device; and a non-transitory computer-readable medium having instructions stored thereon that are executable by the processing device to cause the system to perform operations, the operations comprising:

generating and running a reservoir simulation model, including representative natural fracture or secondary porosity attributes for an area of interest for one or more wells;

generating a synthetic G-function response using results of the reservoir simulation model;

calibrating the synthetic G-function response from the reservoir simulation model to a field G-function response generated using results of a field diagnostic fracture injection test by changing natural fracture characteristics of the reservoir simulation model; and formulating a drilling plan, a completion plan, or both for a wellbore in the area of interest using the synthetic G-function response.

2. The system of claim 1, wherein the instructions are further executable by the processing device to cause the system to perform operations comprising:

controlling a drill bit or a fracturing operation using the drilling plan, the completion plan, or both for the wellbore in the area of interest.

3. The system of claim 1, wherein the synthetic G-function response comprises a maximum horizontal stress direction and a minimum horizontal stress direction for the area of interest, and wherein the instructions are further executable by the processing device to cause the system to perform operations comprising:

controlling a drill bit along a first drilling azimuth that is parallel to a minimum horizontal stress direction for the area of interest with a system permeability less than 0.1 millidarcy, or controlling the drill bit along a second drilling azimuth that is parallel to a maximum horizontal stress direction for the area of interest with system permeability greater than 0.1 millidarcy.

4. The system of claim 1, wherein formulating the drilling or completion plan comprises identifying a drilling azimuth for drilling the wellbore.

5. The system of claim 1, wherein formulating the drilling or completion plan comprises identifying a suitable casing status of the wellbore, a suitable perforation design within the wellbore, suitable proppant mesh sizes, a suitable viscosity of fracturing fluid, or any combination thereof.

6. The system of claim 1, wherein the synthetic G-function response identifies a fracture closure pressure, an Instantaneous Shut-In Pressure (ISIP), an ISIP gradient, a net fracture pressure, a G-function time at fracture closure, a fluid efficiency within a natural fracture, or any combination thereof.

7. The system of claim 1, wherein the synthetic G-function response comprises an indication of a semilog G-function derivative within the area of interest, an indication of pressure within the area of interest, and an indication of a constant pressure derivative within the area of interest.

8. The system of claim 1, wherein the secondary porosity attributes comprise fluid pressure, fluid volume, fluid temperature, relative formation permeabilities, formation capillary pressure relationships, or a combination thereof.

9. A method comprising:

developing a set of representative type curves of diagnostic fracture injection tests for a range of combinations of natural fracture characteristics and matrix characteristics of a reservoir using a reservoir simulation model;

matching a representative profile of a well of interest generated using a field diagnostic fracture injection test with an appropriate type curve of the set of representative type curves to indicate a nature of the natural fracture characteristics and the matrix characteristics;

formulating a drilling plan, a completion plan, or both for a wellbore in the reservoir using the representative profile of the well of interest; and controlling a drill bit or a fracturing operation using the drilling plan, the completion plan, or both for the wellbore in the reservoir.

10. The method of claim 9, wherein the appropriate type curve comprises a maximum horizontal stress direction and a minimum horizontal stress direction for an area of interest of the reservoir, and wherein the method further comprises:

controlling a drill bit along a first drilling azimuth that is parallel to a minimum horizontal stress direction for the area of interest with a system permeability less than 0.1 millidarcy, or controlling the drill bit along a second drilling azimuth that is parallel to a maximum horizontal stress direction for the area of interest with system permeability greater than 0.1 millidarcy.

11. The method of claim 9, wherein the appropriate type curve comprises a type curve from the set of representative type curves that best fits a field type curve of the representative profile of the well of interest.

12. The method of claim 9, wherein formulating the drilling plan, the completion plan, or both comprises identifying a suitable casing status of the wellbore, a suitable perforation design within the wellbore, suitable proppant mesh sizes, a suitable viscosity of fracturing fluid, or any combination thereof.

13. The method of claim 9, wherein the appropriate type curve identifies a fracture closure pressure, an Instantaneous Shut-In Pressure (ISIP), an ISIP gradient, a net fracture pressure, a G-function time at fracture closure, a fluid efficiency within a natural fracture, or any combination thereof.

14. The method of claim 9, wherein formulating the completion plan comprises determining a suitable natural-fracture-to-hydraulic-fracture conditioning ratio.

15. A non-transitory computer-readable medium that includes instructions that are executed by a processing device to perform operations, the operations comprising:

generating and running a reservoir simulation model, including representative natural fracture or secondary porosity attributes for an area of interest for one or more wells;

generating a synthetic G-function response using results of the reservoir simulation model; and calibrating the synthetic G-function response from the reservoir simulation model to a field G-function response generated using results of a field diagnostic fracture injection test by changing natural fracture characteristics of the reservoir simulation model.

16. The non-transitory computer-readable medium of claim 15, the operations further comprising:

formulating a drilling plan, a completion plan, or both for a wellbore in the area of interest using the synthetic G-function response.

17. The non-transitory computer-readable medium of claim 15, the operations further comprising:

controlling a drill bit or a fracturing operation using the synthetic G-function response.

18. The non-transitory computer-readable medium of claim 17, wherein controlling the drill bit comprises controlling the drill bit along an azimuth for drilling a wellbore.

19. The non-transitory computer-readable medium of claim 17, wherein controlling the fracturing operation comprises implementing a suitable casing strategy within a wellbore, controlling a perforation design within the wellbore, controlling a proppant mesh size, controlling a viscosity of fracturing fluid, or controlling any combination thereof.

* * * * *